US005866830A

United States Patent [19]

Onyszkanycz

[11] Patent Number: 5,866,830

[45] Date of Patent: Feb. 2, 1999

[54] HEEL DRIVEN ACTUATOR FOR A PERCUSSION INSTRUMENT

[76] Inventor: Piotr Onyszkanycz, 50 Violet Dr, Apt #603, Hamilton, Ont, L8E 1G6, Canada

[21] Appl. No.: 695,809

[22] Filed: Aug. 12, 1996

[30] Foreign Application Priority Data

Oct. 6, 1995 [CA] Canada ..... 2154008

[51] Int. Cl.[6] ..... G10D 13/02

[52] U.S. Cl. ..... 84/422.1

[58] Field of Search ..... 84/422.1, 422.2

[56] References Cited

U.S. PATENT DOCUMENTS

| | | | |
|---|---|---|---|
| 800,509 | 9/1905 | Stanton | 84/422.1 |
| 2,484,302 | 11/1949 | Laverents | 84/422.1 |
| 2,672,784 | 3/1954 | Sabo | 84/422.1 |
| 3,967,523 | 7/1976 | Currier et al. | 84/422 R |
| 3,988,957 | 11/1976 | Escamilla | 84/422 R |
| 4,134,325 | 1/1979 | Loftus | 84/422 R |
| 4,873,910 | 10/1989 | Kurosaki | 84/422.1 |
| 4,905,565 | 3/1990 | Hoshino | 84/422.3 |
| 5,355,761 | 10/1994 | Ward et al. | 84/422.2 |

*Primary Examiner*—William M. Shoop, Jr.
*Assistant Examiner*—Shih-Yung Hsieh

[57] ABSTRACT

Disclosed is an actuator for a percussion instrument, such as a bass drum. The actuator includes a heel driven pedal, which handles the vertical motion of a free falling leg, and through the motion transmitting lever, which ends with a sound initiation member, transforms it onto the bass drum face until the heel driven pedal reaches a blocking surface of the actuator's base. The user can initiate the percussion instrument by letting his leg to fall down from a raised position while keeping the foot toe in one place on the base. The heel driven pedal, after it reaches the base, is blocked, what prevents from hitting the drum face with unnecessary big force and allows to control the dynamic of play so it does not increase with tempo. The base also allows the heel driven pedal to have a surface from which it can rebound and return to pre-shot position. The motion transmitting lever transmits motion of a heel into motion of a sound initiation member as well as regulates the maximum deflection of the beater into the bass drum face and by this means controls the dynamic of play. The actuator also allows to filter weak shots, which for some reason may not be desired.

19 Claims, 2 Drawing Sheets

HEEL DRIVEN ACTUATOR FOR A PERCUSSION INSTRUMENT

FIELD OF THE INVENTION

This invention relates to a percussion instrument and in particular to a bass drum pedals.

1. Background of the Invention

The creation of this invention is a result of analysing the mechanics of human body in order to use it in the most efficient and effective way, in this case, to operate the drum bass pedal with more precision and less fatigue.

2. Description of the Prior Art

The prior art of bass drum pedals uses mostly the toe driven pedal which has many disadvantages. The main one is that in order to execute a shot the whole leg has to be raised so it does not allow for a fixed point of reference what makes it very difficult to obtain a good coordination over the leg because of its substantial mass and inertia. Another problem is that the leg has to be "thrown up" a time before the shot is needed so it has enough time to fall down and execute the shot, but, because the time that is needed for the leg to go up and fall down is substantial, it is very difficult and in many situations impossible to execute two or more shots in a short time each after another. A different technique used to operate the toe driven pedal is when the whole foot is placed on the pedal but this method limits the variety of rhythyms that can be performed and is very fatiguing after a short time of playing. The reasons which are mentioned above make the operation of playing a bass drum to be difficult and not precise, and cause a very restraining pain, stiffness and tiredness what negatively impacts performance, liming the drummer to play only the save, easier rhythms, rather than the rhythms that are being felt. The U.S. patents which disclose this idea are: U.S. Pat. Nos. 4,134,325; 4,873,910; 3,967,523.

Some prior art pedals use a heel driven pedal to operate the actuator but they place a leg in a very inconvenient position in which it is very difficult to operate the pedal They also do not have a fixed stopping point for the heel member what causes to lose a whole leg's energy in a first shot by overstretching the face of the drum. The U.S. patents which disclose these art are: U.S. Pat. Nos. 3,988.957 and 5,355, 761.

SUMMARY OF THE INVENTION

The principle behind the invention is to maximize control over the leg which is responsible for the bass drum effect The invention is based on the idea that the best way to coordinate the leg is to release the foot muscle and the falling: leg is doing the rest. This invention provides a much better control over the bass drum than the prior art, which requires involvement of many muscle groups to do the same job. The other problem that is overcome by this invention is that it provides a third point of stability for the drummer's body. The foot toe does not have to move and is allowed to rest in one position while the drummer's leg is executing the movement. To have three fixed points is the only way of securing and object—in our case; human body—in the space. The other two points are: the heel of a leg operating hit-hat cymbals and the seat. Finally, this invention provides a way of eliminating or filtering shots which may be too weak and because of that not desired, The invented bass drum actuator accommodates player's leg in such a way that its inertia and weight becomes an advantage rather than a problem—as it is using current state of art. The technique that allows for doing that is "instant foot muscle release" rather than the "jump and fall" technique which is used currently. Using the invented bass drum actuator gives following advantages:

The player's leg is set in the position where the smallest and therefore the most operative muscle of the leg—foot muscle—takes care about executing the shot on a drum face by letting the leg fall from a raised position. The weight and inertia of a hum leg does the rest. The electrobiological signal "release" that goes from brain to foot muscle is everything what is needed to execute the shot on the drum face. The use of this invention allows for much higher precision of operation as well as significantly increases the easiness of playing and the variety of rhythms which can be played.

The invention allows for a complete relaxation of all leg muscles after a shot is executed and, because of that, significantly decreases fatigue and increases the ability for better, longer operation by freeing the leg muscles from constant pressure which causes muscle stiffness.

The invention provides a point of reference for the operating leg by letting the foot's toe to rest in one position what allows a better control over the leg and secures the balance of a drummer's body. Having a stable point of reference is very important since it eliminates a feeling of "hanging in the air", which happens when all parts of the leg have to change position while the shot is being executed.

The invention allows to stop the heal pedal on the base of the actuator what provides a firm point of rebound for the operating leg allowing for any easy return to the pre-shot position (heel is up).

The invention allows to decide about what percentage of force applied on a heel pedal will be transmitted on the drum face by using a percentage of transmitted motion adjuster. This feature allows to play a bass drum at different volumes without changing the way of operating the pedal, what effectively isolates tempo (how fast) from dynamic (how much volume).

Another advantage that the invention has over the prior art is the ability to filter shots which for some reason may be too weak and because of that not desired.

The invention provides a feature which allows to choose whether or not the drum face will vibrate or not after the shot was executed without changing the technique of playing. To manufacture this invention light metals and moulding process should be applied. Other materials used in drum pedals currently manufactured may be used as well. Durable rubber or other elastic materials may be used to quiet and soften the stop of heel pedal.

BRIEF DESCRIPTION OF THE DRAWINGS

The drawings which illustrate embodiments of the invention are.

DETAILED DESCRIPTION OF THE PREFERRED EMBODIMENT

Figure 1:
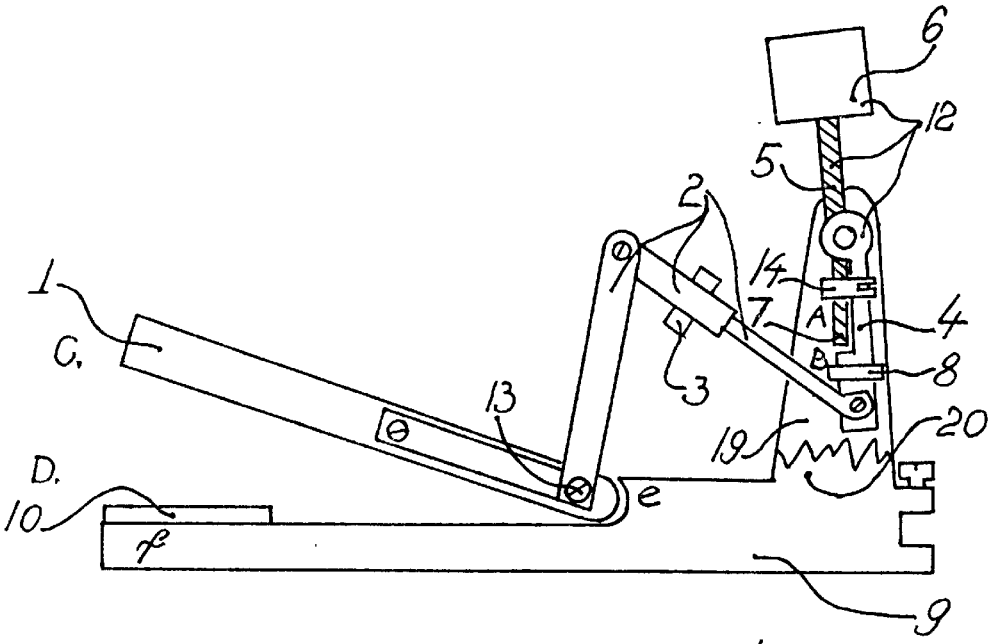
FIG. 1 shows a side view of the embodiment in its rest position, before a leg pressure has been applied.

Referring now to FIGS. 1 to 4, the illustrated actuator for a percussion instrument comprises a heel driven pedal (1)

which is joined by rotative means (13) to a two level base (9). Rotative means (13) permits the heel driven pedal (1) to pivot relative to base (9) as best viewed in FIGS. 1 and 3. The rotative means (13) is located on the base to suit the mechanics of a human leg when the leg's toe or forward portion of the foot is placed on base (9) and the rest of a foot is placed on heel driven pedal (1) and is: free to move up and down. The operation of the actuator is based on moving the heel driven pedal (1) from a high position (C) shown in FIG. 1 to a stop position (D) shown in FIG. 2. Urging heel driven pedal (1) from a high position (C) to a stop position (D) creates a vertically-circular motion which is converted to a horizontally-circular motion by motion transmitting levers (2) and sound initiation members (12).

The depth of penetration of beater (6) is adjusted by transmitted motion adjuster (3) which is integrally part of a motion transmitting lever (2), in the form of a turnbuckle for example, and is connected to pushing arm (4) of sound initiation members (12). The sound initiation members (12) are made of pushing arm (4), a responding arm (5 & 7), and an actuation member preferably shown as a beater (6). Responding arm (5 and 7) has lower end (7) and upper end (5) which has a beater (6) attached. Pushing arm (4) of sound initiation members (12) is attached to first shaft (15) which is pivotally mounted to support (19) at one end. Responding arm (5 and 7) is attached to second shaft (16) which is pivotally mounted to support (20) and to support (19). First shaft (15) and second shaft (16) are positioned along and pivot about the same axis. Preferably the smaller diameter shaft is concentrically mounted through the interior of the larger diameter shaft (not shown in the drawings) in order that one shaft extend across both supports (19) and (20) Shafts (15) and (16) pivot independently of each other.

Figure 2:
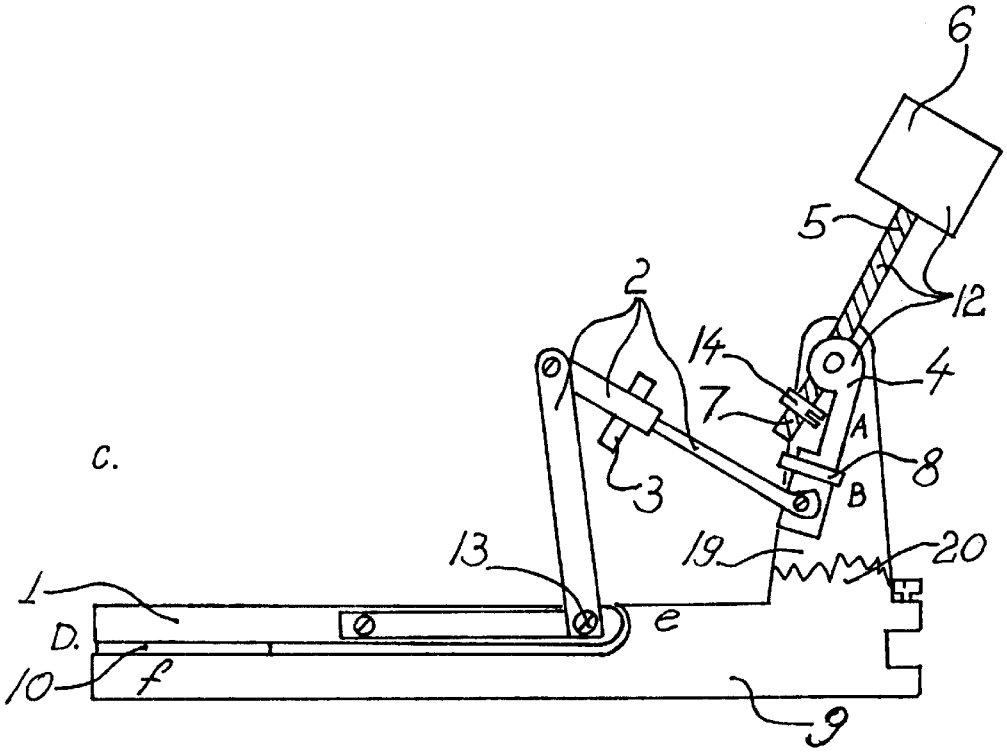
FIG. 2 shows a side view of the embodiment in its shot position—after the leg pressure has been applied.

Pushing arm (4) pivoted by the motion transmitting levers (2) pivots responding arm (5 and 7) which in turn urges beater (6) toward a drum face (not shown). The Pushing aim (4) of sound initiation members (12) is supplied with a fixing nut (8), which threadably engages pushing arm (4) and selectively threadably engages the lower end (7) of responding arm (5 and 7) and can be turned to be in A or B position, fixing or freeing respectively the responding arm (5 and 7) from the pushing arm (4). When fixing nut (8) is in position A, pushing arm (4) and responding arm (5 and 7) are rigidly fixed together and pivot in unison about the axis which first shaft (15) and second shaft (16) are positioned along. When fixing screw (8) is in position B, pushing arm (4) is pivotally connected to responding arm (5 and 7), and responding arm (5 and 7) is free to pivot independently or together with pushing arm (4) as best shown in FIG. 2.

When pushing arm (4) and responding arm (5 and 7) of the sound initiation members (12) are fixed together they behave like one body and transmitted motion adjuster (3) can be used to regulate how deep into a drum face (not shown) the beater (6) will go by this means, one can control the beater penetration into the drum face (not shown). When the fixing screw (8) is in position B, then the transmitted motion adjuster (3) may for example be adjusted to stop the pushing arm (4) before the beater (6) contacts the drum face, however, beater (6) will hit the drum face under its own inertia since responding arm (5 and 7) can pivot independently of pushing an 4. Beater (6) will rebound back off the drum face and leave the drum face in a vibrating state.

Figure 3:
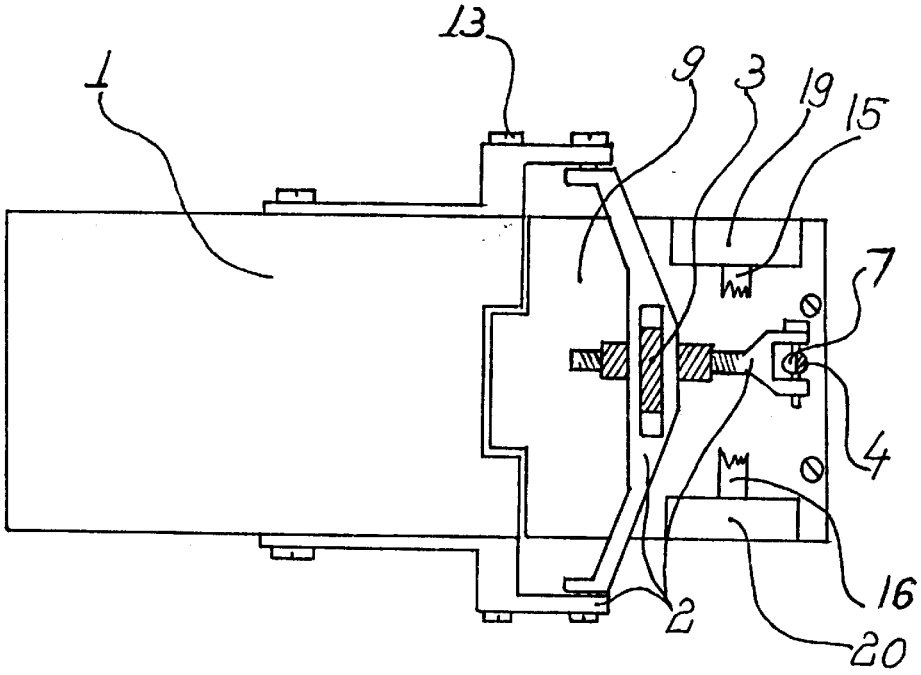
FIG. 3 shows a top view of the embodiment.
Figure 4:
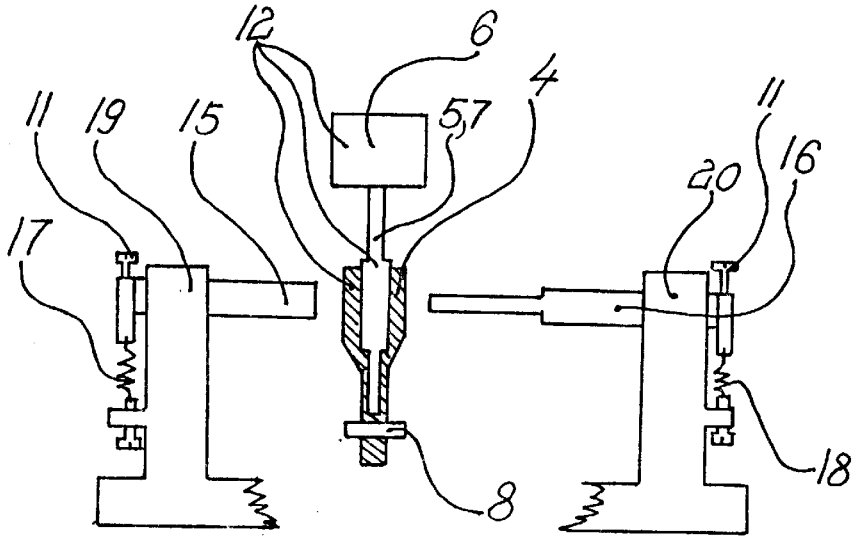
FIG. 4 shows a part of the embodiment which illustrates the use of two independently adjust able axes.

As Best viewed in FIGS. 3 and 4 the responding arm (5 and 7) is connected to second shaft (16) which is pivotally mounted to support (20) and (19) and a resilient negative bias force is applied preferably by a spring (18) which urges beater (6) in a counter clockwise rotation away from the drum face. A rest angle adjuster (11) regulates the position at which the heel driven pedal (1) will be located in its rest position which is at high position (C), and resilient bias on spring (17) regulates the negative bias on the heel driven pedal (1) which provides resistance to moving heel driven pedal (1) from high position (C) to a stop position (D)). Rest angle adjuster (11) regulates the rest position of beater (6) and the resilient bias on spring (18) regulates the negative bias on the beater (6) which provides the resistance to moving beater (6) from the rest position to a return position. The return position of beater (6) being the maximum proportional position of the actuation member, when the heel driven pedal (1) is in the stop position (D). Beater (6) moves proportionally to heel driven pedal (1) when fixing nut (8) is in position A. When fixing nut (8) is moved to position B, beater (6) is free to move proportionately or disproportionately with heel driven pedal (1).

A resilient holder (14) may be used to releasably hold together pushing arm (4) and responding arm (5 and 7) of a sound initiation members (12) so that they go apart only if the force of inertia of the responding arm (5 & 7) is great enough to overcome the resilient hold of resilient holder (14). Changing the position of resilient holder (14) on the responding arm (5 and 7) will change the moment arm length at which the separation force is acting and therefore will allow for selectively predetermining beater (6) shots of a different strength. For example; the further away resilient holder (14) is located from first and second shafts (15) and (16) respectively the greater is the required pivoting moment or inertia of beater (6) to free responding arm (5 & 7) from pushing arm (4).

The. two level base (9) is used in two ways: firstly the higher part (e) is used as the resting place for a foot's toe portion and secondly the lower part (f) as the stop for the heel driven pedal (1). A noise absorbing rubber (10) is located at the distal end of the lower part (f) of the base (9) and it prevents unneeded noise, and determines a maximum deflection point ie touch base position D, for the heel driven pedal (1), and as well as makes the stop of the heel driven pedal (1) a softer and more comfortable one.

Having described my invention, I claim:

1. A heel driven actuator for a percussion instrument comprising:

(a) a base having a means to support a user's toe;

(b) a heel driven pedal, said heel driven pedal being able to pivot between a high position and a stop position, the stop position being a position of said heel driven pedal in which said heel driven pedal is stopped with use of a stopping means;

(c) an actuation member for actuating the percussion instrument;

(d) means for converting pivoting motion of said heel driven pedal into a motion for actuating said actuation member, said converting means connecting said pedal and said actuation member; and, (e) said converting means comprises a fixing means having a first position and a second position, said first position connecting the motion of said pedal to said actuation member, said second position allowing the actuation member to continue to move under its own inertia after the pedal has reached the stop position.

2. The heel driven actuator according to claim 1, wherein the converting means proportionally converts the motion of the heel driven pedal into motion of the actuation member such that the actuation member stops when when the heel driven pedal has reached the stop position.

3. The heel driven actuator according to claim 1, wherein said converting means proportionally converts the motion of the heel driven pedal into motion of the actuation member and wherein the converting means further comprises a means for adjusting the return position of the actuation member, such that the return position being the maximum proportional position of the actuation member when the heel driven pedal is in the stop position.

4. The heel driven actuator according to claim 3, wherein said converting means comprises motion transmitting levers, said adjusting means comprises a turnbuckle interposed between ends of at least one motion transmitting lever for adjusting the length of at least one motion transmitting lever.

5. The heel driven actuator according to claim 1, wherein the converting means comprises motion transmitting levers connected at a first end to the heel driven pedal and at a second end to sound initiation members, said sound initiation members including said actuation member for actuating the percussion instrument.

6. The heel driven actuator according to claim 5, wherein said sound initiation members comprise a pushing arm connected to said motion transmitting levers at said second end, and said pushing arm also connected to a responding arm, the responding arm also being connected to said actuation member.

7. The heel driven actuator according to claim 6 wherein said pushing arm further comprises a resilient holder for releasably holding together said pushing arm and said responding arm and releasing said responding arm, when said fixing means is also released, at a predetermined level of force acting on the resilient holder, the force applied to said resilient holder resulting from the inertial pivoting mement of the responding arm and the attached actuation member.

8. The heel driven actuator according to claim 6, wherein said pushing arm and said responding arm are rotatably connected to an axis about which they pivot.

9. The heel driven actuator according to claim 8 wherein said pushing arm and said responding arm are fixedly attached together and pivot in unison about said axis when said fixing means is in said first position; and said pushing arm and said responding arm are free to pivot independently about said axis when said fixing means is in said second position.

10. The heel driven actuator according to claim 9 wherein said fixing means is a fixing nut which threadably engages said pushing arm and selectively also threadably engages said lower end of said responding arm.

11. The heel driven actuator according to claim 1, wherein said actuation member comprises a beater for striking the drum face.

12. A heel driven actuator for a percussion instrument comprising:

(a) a base having a means to support a user's toe;

(b) a heel driven pedal, said heel driven pedal being able to pivot between a high position and a stop position, the stop position being a position of said heel driven pedal in which said heel driven pedal is stopped with use of a stopping means;

(c) an actuation member for actuating the percussion instrument;

(d) means for converting pivoting motion of said heel driven pedal into a motion for actuating said actuation member; said converting means connecting said pedal and said actuation member; and, (e) the converting means allows the actuation member to continue to move under its own inertia after the heel driven pedal has reached the stop position.

13. The heel driven actuator according to claim 12, wherein the converting means further comprises biasing means for applying negative resilient bias for resisting the motion of said heel driven pedal and said actuation member.

14. The heel driven actuator according to claim 13, wherein the biasing means independently applies negative resilient bias to the actuation member and the heel driven pedal.

15. The heel driven actuator according to claim 12, wherein the converting means further comprises a means for setting the rest position of the actuation member and the rest position of the heel driven pedal, said setting means being able to change said rest positions.

16. The heel driven actuator according to claim 15, wherein the settings means independently sets the rest position of the actuation member and the rest position of the heel driven pedal.

17. The heel driven actuator according to claim 12 wherein the converting means comprises a means for filtering, said filtering means being able to set a predetermined level of force which must be overcome by the actuation member before the actuation member is allowed to move under its own inertia after the heel driven pedal reached the stop position.

18. The heel driven actuator according to claim 12, wherein the stopping means comprises a rigit barrier upon which the heel driven pedal impinges, said barrier has some reliliency to cushion the user's foot.

19.The heel driven actuator according to claim 12, wherein the converting means includes a setting means for selectively setting the position from which the actuation member begins to move under its own inertia.

* * * * *